US011286072B2

(12) United States Patent
Jorge Alesanco et al.

(10) Patent No.: US 11,286,072 B2
(45) Date of Patent: Mar. 29, 2022

(54) DEVICE AND METHOD FOR PACKAGING PRODUCTS IN PRE-MADE PACKAGES

(71) Applicant: NEXES CONTROL DESIGN ENGINEERING S.L.U., Barcelona (ES)

(72) Inventors: Cristobal Jorge Alesanco, Barcelona (ES); Oscar Martinez Lopez, Sabadell (ES)

(73) Assignee: NEXES CONTROL DESIGN ENGINEERING S.L.U., Sant Joan Despi (ES)

( * ) Notice: Subject to any disclaimer, the term of this patent is extended or adjusted under 35 U.S.C. 154(b) by 255 days.

(21) Appl. No.: 16/347,681

(22) PCT Filed: Nov. 13, 2017

(86) PCT No.: PCT/ES2017/070748
§ 371 (c)(1),
(2) Date: May 6, 2019

(87) PCT Pub. No.: WO2018/087414
PCT Pub. Date: May 17, 2018

(65) Prior Publication Data

US 2019/0315505 A1 Oct. 17, 2019

(30) Foreign Application Priority Data

Nov. 14, 2016 (EP) ..... 16382530

(51) Int. Cl.
*B65B 43/16* (2006.01)
*B65B 3/04* (2006.01)
(Continued)

(52) U.S. Cl.
CPC ..... *B65B 43/16* (2013.01); *B65B 3/04* (2013.01); *B65B 43/32* (2013.01); *B65B 43/465* (2013.01);
(Continued)

(58) Field of Classification Search
CPC ..... B65B 43/16; B65B 43/32; B65B 43/465; B65B 43/54; B65B 3/04; B65B 51/146; B65B 65/006; B65B 2210/02
(Continued)

(56) References Cited

U.S. PATENT DOCUMENTS 3,762,253 A * 10/1973 Loomis, Jr ..... B65B 9/093 83/102
6,191,507 B1 * 2/2001 Peltier ..... B65G 54/02 310/12.02
(Continued)

FOREIGN PATENT DOCUMENTS

DE 34 16 557 A1 11/1985
EP 2 886 470 A1 6/2015
(Continued)

OTHER PUBLICATIONS

International Search Report for PCT/ES2017/070748 dated Mar. 1, 2018 [PCT/ISA/210].
European Search Report for EP 16 38 2530 dated May 17, 2017.
Written Opinion for PCT/ES2017/070748 dated Mar. 1, 2018 [PCT/ISA/237].

*Primary Examiner* — Dariush Seif
(74) *Attorney, Agent, or Firm* — Sughrue Mion, PLLC

(57) ABSTRACT

An apparatus (1) for the packaging of products in pre-made containers (100, 101) that comprises a receiving station (2) for containers and at least two workstations (3, 4) each on one side of that receiving station; the apparatus comprising container transfer means (5) that are equipped with at least two holding groups (6, 7) prepared to hold containers in a suspended way and that can move between at least two
(Continued)

positions, one that coincides with the container receiving station (2) and the other that coincides with one of the two workstations (3 or 4), such that the transfer means are able to serve the pre-made containers received in that receiving station to one side and to the other side of the receiving station, and to corresponding workstations, in an alternating way.

17 Claims, 9 Drawing Sheets

(51) Int. Cl.

| | |
|---|---|
| ***B65B 43/32*** | (2006.01) |
| ***B65B 43/46*** | (2006.01) |
| ***B65B 43/54*** | (2006.01) |
| ***B65B 51/14*** | (2006.01) |
| ***B65B 65/00*** | (2006.01) |

(52) U.S. Cl.
CPC ..... *B65B 43/54* (2013.01); *B65B 51/146* (2013.01); *B65B 65/006* (2013.01); *B65B 2210/02* (2013.01)

(58) Field of Classification Search
USPC ..... 53/450–453, 455, 545, 550–555, 75
See application file for complete search history.

(56) References Cited

U.S. PATENT DOCUMENTS

| | | | | |
|---|---|---|---|---|
| 6,401,439 | B1 * | 6/2002 | Tetenborg | B65B 43/465 53/567 |
| 2008/0051937 | A1 * | 2/2008 | Khan | B65B 3/30 700/240 |
| 2009/0056281 | A1 * | 3/2009 | Murray | B65B 31/042 53/455 |
| 2009/0308028 | A1 * | 12/2009 | Koelker | B65B 65/003 53/450 |
| 2009/0320958 | A1 * | 12/2009 | Matheyka | B65B 25/005 141/98 |
| 2010/0269458 | A1 * | 10/2010 | Veix | B65B 43/26 53/570 |
| 2014/0352253 | A1 * | 12/2014 | Yamamoto | B29C 66/0062 53/76 |
| 2016/0122063 | A1 * | 5/2016 | Garriga Jimenez | B65G 54/02 53/551 |
| 2018/0050829 | A1 * | 2/2018 | Borgstrom | B29C 66/43123 |

FOREIGN PATENT DOCUMENTS

| | | |
|---|---|---|
| EP | 2 998 232 A1 | 3/2016 |
| GB | 1 585 703 A | 3/1981 |

* cited by examiner

DEVICE AND METHOD FOR PACKAGING PRODUCTS IN PRE-MADE PACKAGES

CROSS REFERENCES TO RELATED APPLICATIONS

This application is a National Stage of International Application No. PCT/ES2017/070748 filed Nov. 13, 2017, claiming priority based on European Patent Application No. 16382530.0 filed Nov. 14, 2016.

APPLICATION FIELD OF THE INVENTION

The invention relates to an apparatus which receives pre-made containers, for example, of a flexible type, and which comprises several workstations to be able to carry out several operations on the containers, such as filling and sealing. The invention also relates to a method that uses this apparatus and distributes the containers that are supplied to it in a specific way among the workstations.

BACKGROUND OF THE INVENTION

In the scope of packaging, and more specifically, the packaging of products in a flexible container, automatic machines that comprise a production module and a packaging module are known. In the production module, the containers are made from the supply of one or more continuous bands of a flexible material to create a train of individual open containers that are sequentially transferred to a packaging module that is adjacent to it; it is here that those containers are filled and sealed in the respective workstations to which the containers are transported. In addition to filling and sealing containers, many other operations can be carried out according to product needs and container type. The machine usually has as many stations as different operations that should be carried out on the container.

It is also common to have a packaging process that receives the pre-made containers from a warehouse, or a portable loading unit, instead of from a production module.

In the packaging modules, regardless of whether they are the type in which containers are transferred to them from a production module or the type in which they receive containers from a warehouse or portable loading unit, the packaging speed or capacity is determined by the operation with the longest execution time in the packaging chain. As long as this operation in the station to which it corresponds continues, that station cannot receive new containers from an upstream station nor can it transport containers to a station that comes after it on the packaging chain. To increase the capacity of the packaging modules, it is common to duplicate the number of stations or divide the operation with the longest execution time into two adjacent stations so that said operation can be carried out in two machine actions or two cycles that move the containers along the chain.

A first objective of the invention is to provide an alternative to this method which reduces the bottleneck effect that results from having to execute a lengthy operation on a packaging chain and that sets the pace of the chain movement.

The apparatus and the method that are proposed aim to increase the performance and capacity of a conventional packaging module without duplicating the total number of workstations.

It is also of interest that the proposed solution be implemented in a simple way; in other words, a way that does not increase the mechanical complexity of the apparatus and, specifically, of the transfer means of the containers from one station to another.

Another objective of the invention is an apparatus and method that are more versatile and are easily adaptable to changes to the container format.

Furthermore, an objective of the invention is an apparatus and a method that are more compact in comparison with those based on a simple or duplex packaging chain (with two stations per operation that is carried out on the containers and where two containers per movement cycle of the single chain end up).

DESCRIPTION OF THE INVENTION

The apparatus objective of the invention is an apparatus suitable for the packaging of products in pre-made containers that comprises a receiving station for a container or group of containers and at least two workstations that are arranged with one on each side of that receiving station; the apparatus comprising container transfer means that are equipped with at least two holding groups that are each prepared to hold in a suspended way a corresponding container or group of containers and that can move between at least two positions, one that coincides with the container receiving station and the other that coincides with one of the two workstations, such that the transfer means are able to serve the pre-made containers received in that receiving station to one side and to the other side of the receiving station, and to corresponding workstations, in an alternating way.

Advantageously, while the first holding group is waiting to hold a container or a group of containers in a location that is different from the receiving station, the other holding group can wait to receive a new container or group of containers in the receiving station. This significantly improves the production capacity of the apparatus and makes it especially optimal when the receiving station is equipped with means to carry out the operation on the container or group of containers that are transferred to it, the duration of which is less than the duration of the operation carried out in the workstation or stations arranged on each side of said receiving station.

These advantages become more evident when the drive of the holding groups is individual, which means that the holding groups do not necessarily have to move in unison, the holding groups being able to be temporarily each in a different station and therefore, there is temporarily no clamping group in the receiving station.

Therefore, in a variant of the invention, the apparatus is adapted to or has the ability to individually move the clamping groups between the receiving station and the work station or stations, at least between the receiving station and the workstation or workstations on the same side of the receiving station.

In a variant, the transfer means comprise a track or guide element upon which the holding groups are mounted in a sliding way and in the two transportation directions possible.

Since the holding groups essentially move in a back-and-forth direction, the track or guide element can follow an open and preferably straight path.

Each of the holding groups can comprise pairs of arms that are each equipped with a gripper device, such that each arm is mounted on the track or guide element in a sliding way and in the two possible transportation directions. Each pair of arms, by means of its gripper, is responsible for receiving, holding and transporting a container.

The operation of each holding group can be mechanical and the arms of each holding group are able to open apart or close together. However, a preferred variant of the invention is that each arm of each holding group shall be operated individually along the track or guide element.

In a variant of the apparatus, each holding group or, when applicable, each arm of each holding group can be operated individually so as to slide along the track or guide due to a magnetic field generated in the area of influence of each transportation group or each arm; the apparatus comprising some programmable means of control that are able to individually control the movement of those holding groups or, when applicable, each arm of each transportation group.

According to this variant, the implementation of format changes is simplified so that the apparatus can quickly adapt to different container sizes and configurations.

In an embodiment, at least one workstation on each side of the receiving station is equipped with a fixed holding group of containers, to which the mobile holding groups can transfer the held containers when they are in a static position that coincides with said workstations. Advantageously, the associated holding groups, when empty, can start to return to the container receiving station even when the operation that is carried out in said workstations has not yet ended.

In a variant of the invention, the apparatus comprises one workstation on each side of the receiving station. In a variant of the invention, the apparatus comprises one workstation on each side of the receiving station.

In a specific variant, the apparatus comprises two workstations on each side of the receiving station, and each holding group moves between the container receiving station and each of the two workstations arranged on the same side of the receiving station, whereby the transfer means are not only able to send the pre-made containers received in said receiving station to one side of the receiving station and to the other, and to corresponding workstations, in an alternating way, but can also transport them from one workstation to another one that is adjacent to it.

According to a characteristic of a variant of the simple invention, in which containers are received and transferred one at a time, the gripper device associated with the arm that is the furthest from the receiving station is retractable, thus being able to adopt an operating position (A) and a retracted position (B) which allows the associated arm that is in the direction of the receiving station to operate without having to pull the container away from its natural delivery position.

In cases where groups of containers are received and transferred instead of one container at a time, several grippers will be able to retract or withdraw themselves to allow the arms associated in the direction of the receiving station to operate without interfering with the group of containers that was released moments before.

In a variant, at least two workstations, one on each side or both sides of the receiving station, are prepared to carry out the same operation on the containers. It is also expected that the operation or some of the operations that are carried out on one side of the receiving station are different from those that are carried out on the other side of the receiving station, so that different containers can be finished on one side and the other of the receiving station.

Furthermore, the invention envisages that the number of workstations on one side and the other of the receiving station are different.

Preferably, the receiving station is equipped with filling means for the containers that are transferred to it.

According to another aspect of the invention, a method for packing products in pre-made containers used in the apparatus according to claim 1 is made known, which comprises a) the transfer of at least a first pre-made container to the receiving station so that it is held by a first holding group located in a standby position at that receiving station;
b) moving this first holding group from the receiving station to a first workstation located on a first side of the receiving station, transporting with it the first container;
c) moving a second empty holding group from a workstation located on a second side of the receiving station to the aforementioned receiving station, disposing it at the said standby position in the receiving station;
d) the transfer of at least a second pre-made container to the receiving station so that it is held by the second holding group located in the standby position at that receiving station;
e) moving this second holding group from the receiving station to a second workstation located on the aforementioned second side of the receiving station, transporting with it the second container; and
f) moving the first holding group empty from a workstation located on the first side of the receiving station to the aforementioned receiving station.

In a preferred variant of the method, at least operations b) and c) or e) and f) are carried out simultaneously in full or in part.

According to an embodiment, a station on each side of the receiving station is prepared to hold the container or group of containers that are transferred to it in a way that, prior to step f) of moving that first holding group empty from one of the workstations to said receiving station, it comprises the transfer of the container or containers to said workstation.

In a variant of interest in which there is a workstation on each side of the receiving station, a packaging operation, such as a filling action, is carried out on the container or, if applicable, on the group of containers that is held in said receiving station with an associated execution time t; and a packaging operation that is different from the one carried out in the receiving station, such as a sealing action, is carried out on the container or containers in each of the first and second workstations, each one located on one side of the receiving station, with an associated execution time T, where $t<T$.

In another variant of interest, in which there is more than one workstation on each side of the receiving station and the same holding group transports a container or a group of containers from one workstation to another one that is adjacent to it; and a packaging operation, as well as a filling action, is carried out on the container or containers that are held in the receiving station with an associated execution time t; and packaging operations that are different from the ones carried out in the receiving station are carried out in the workstations (3 and 33; 4 and 44) on the same side of the receiving station with an accumulated associated time Ta, where $t<Ta$.

It is of interest that in the operations a) and d), the containers are open as they are transferred to the receiving station.

DETAILED DESCRIPTION OF THE INVENTION

Figure 1:
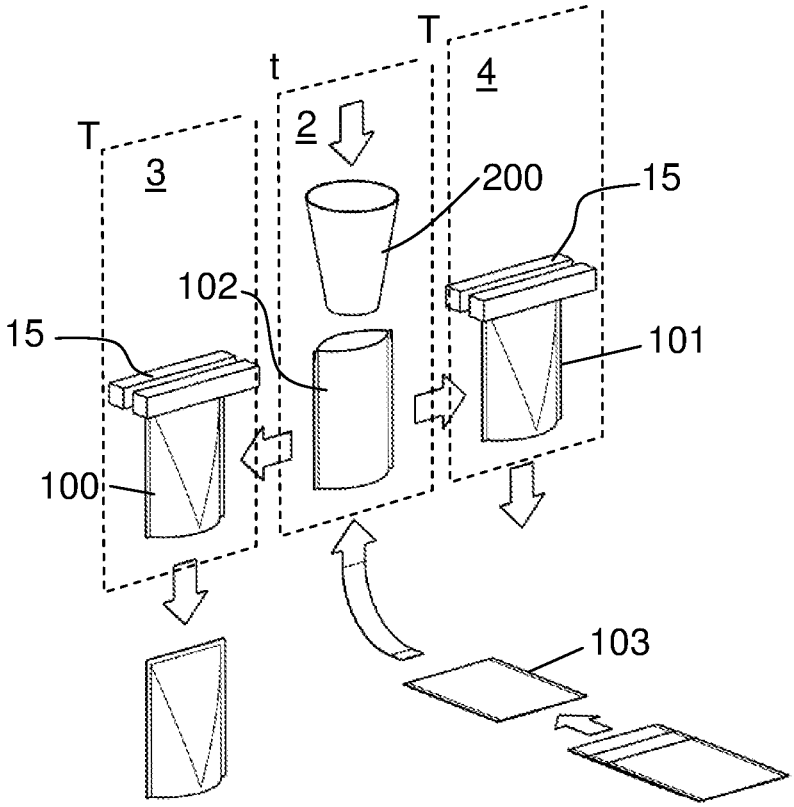
FIG. 1 is a schematic view of the method for packing products in pre-made containers according to the invention, according to a simple variant.

FIG. 1 is a schematic view of the method for packing products in pre-made containers according to a simple variant of the invention. The method of FIG. 1 is based on having two workstations 3, 4, each one arranged on either side of the container receiving station 2; and where subsequent containers 100, 101, 102, 103 and the ones that follow, which are received in that receiving station 2, are moved to one side of that receiving station 2 and to the other and to the workstations 3 and 4 in an alternating way.

Figure 2:
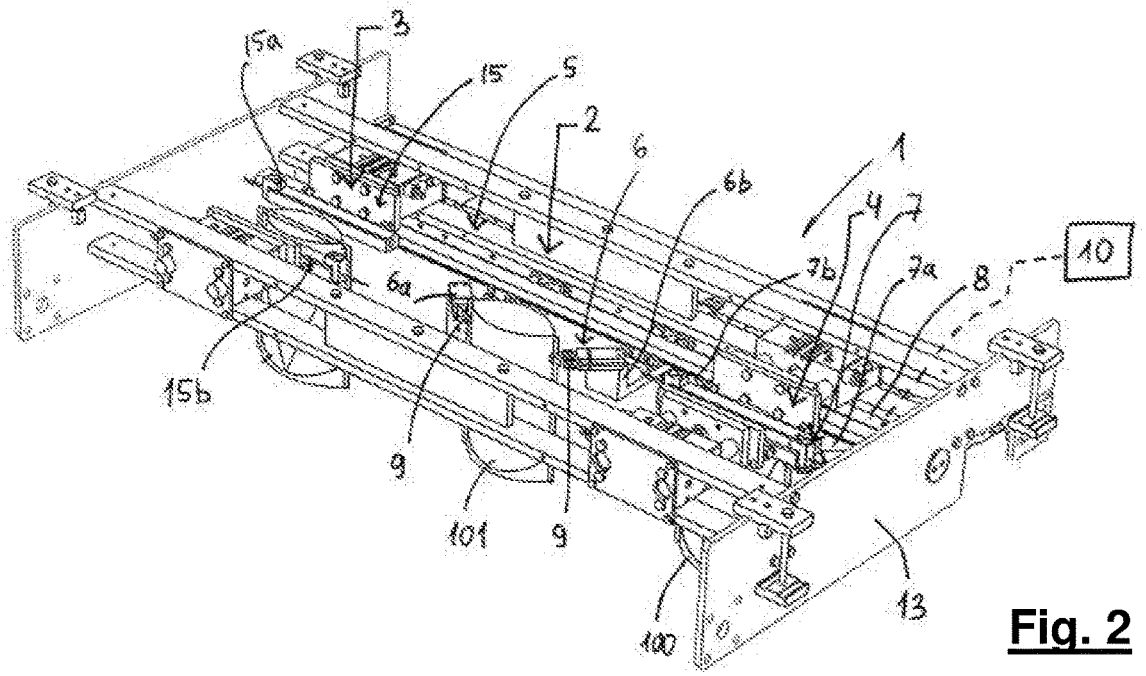
FIGS. 2 and 3 show a perspective view of an apparatus to implement that method shown in FIG. 1, with three workstations; a receiving station, centered and equipped with a container filling group; and two workstations, each one located on one side of the receiving station and equipped with container sealing groups.
Figure 3:
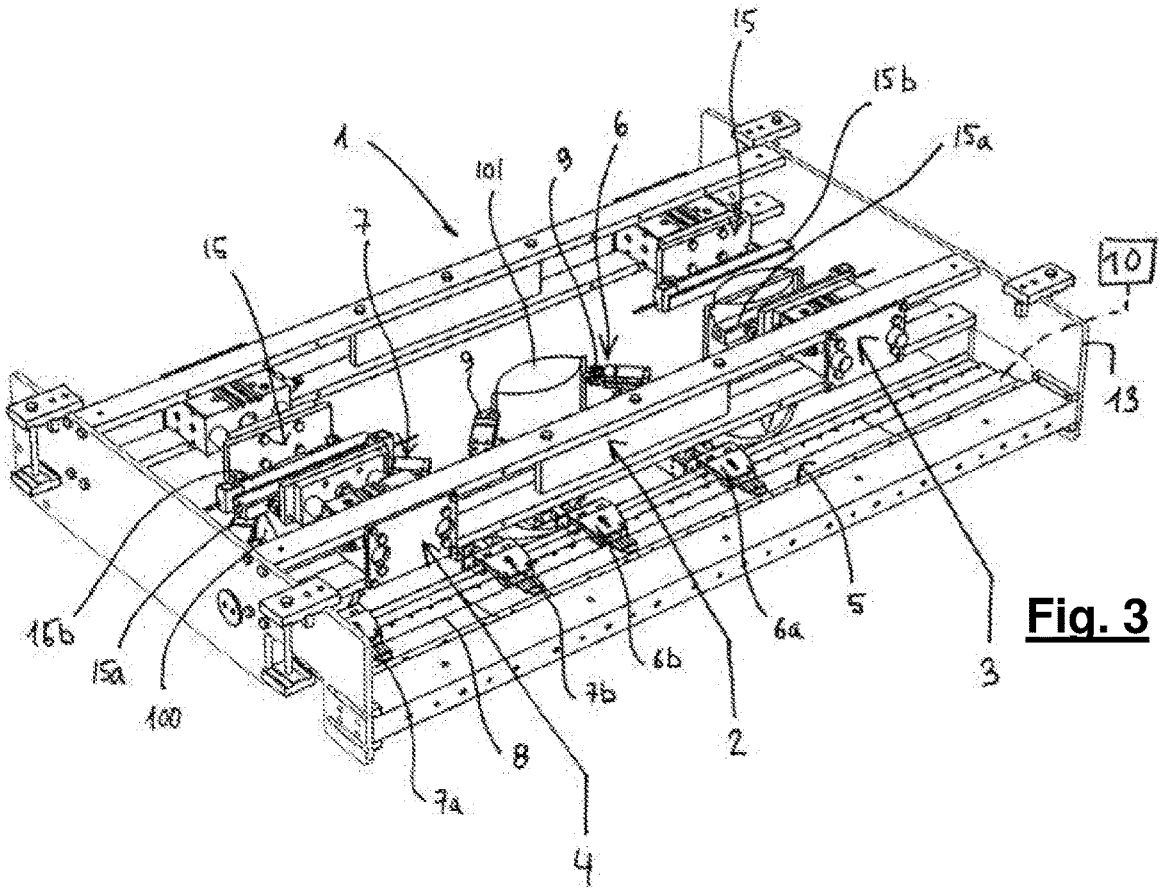

FIGS. 2 and 3 show an apparatus 1 that implements this simple variant of the method according to different points of view and having the instant position adopt its mobile parts or components.

This apparatus 1 comprises a frame 13 that serves as support for transfer means 5 of containers based on a motorized element that can ensure the individual and controlled movement of a plurality of pallets due to magnetic coupling.

This type of system has been described in literature for a long time, for example, in patent document U.S. Pat. No. 6,191,507, which describes a track formed by interconnected track sections, forming a continuous track, wherein each track section features a plurality of individually controlled coils stretching along the length thereof and wherein plural pallets with magnets travel independently along the track. However, individualized systems of control, by means of the use of position sensors were not perfected until years later so that it could be implemented in a cost effective and technically feasible way in the scope of packaging, as in the example of patent document U.S. Pat. No. 6,876,107.

In the apparatus 1, the aforementioned transfer means 5 comprise a track or guide element 8, attached to the frame 13, and the pallets are configured in the shape of arms 6*a*, 6*b*, 7*a* and 7*b* that, grouped in pairs, determine a first and second holding group 6 and 7, respectively, where each arm is equipped with a gripper device 9 that can attach to a lateral edge of a container 100, 101 of a flexible type that is, for example, configured in the shape of a flat pouch or stand-up pouch.

In FIGS. 2 and 3, the first holding group 6, through cooperation of the grippers 9 of the arms 6*a* and 6*b*, is responsible for holding the container 101; and the second holding group 7, through cooperation of the grippers 9 of the arms 7*a* and 7*b*, is responsible for holding the container 100.

The apparatus 1 comprises programmable means of control 10, shown in a schematic view in FIGS. 2 and 3, which govern the coordinated movement of the pairs of arms 6*a* and 6*b*, 7*a* and 7*b*, as well as the operation of the associated grippers 9, so that they can move the holding groups 6 and 7 along the track or guide element 8 and operate the grippers 9 to grasp or release containers. In practice, this allows containers to be received, moved and released as necessary along the track or guide element 8.

Unlike known packaging modules which use a track or guide element that follows a circular path so that the holding group that moves a container to the end of a chain can once again adopt a starting position and hold a new container; in the apparatus 1 of FIGS. 2 and 3, the track or guide element 8 does not follow a closed path.

One particular feature of this apparatus 1 is the fact that is comprises a centered container receiving station 2 and two workstations 3, 4 that are arranged with one on each side of that receiving station 2.

The first and second holding groups 6, 7 will each move in a back-and-forth way between this receiving station 2 and one of the workstations 3 and 4, respectively, such that the transfer means 5 will move the pre-made containers received in the aforementioned receiving station 2 to one side of said receiving station 2 and to the other and to the workstations 3 and 4 in an alternating way.

In the apparatus 1 of the example, the receiving station 2 is equipped with a filling group 200 (shown in a schematic view in FIG. 1) and each one of the workstations 3 and 4 are equipped with identical container sealing groups 15, mounted in a suspended way on the frame 13.

As is known, each of these container sealing groups 15 comprise a pair of welding clamps 15*a*, 15*b* that can apply heat and pressure to the juxtaposed walls of the containers in order to seal them by means of thermal welding. The clamps 15*a*, 15*b* are arranged above the grippers 9 when the holding groups 6,7 place the container to be sealed on the workstations 3 and 4, so that by simultaneously sealing the containers, they carry out the function of the fixed holding groups of the containers, to which the mobile holding groups 6, 7 can transfer the held containers 100, 101 when they are in a static position that coincides with said workstations 3,4.

Advantageously, in the apparatus 1, although the sealing operation that is carried out on the container 100 on workstation 4 located on one side of the receiving station 2 requires an execution time T greater than the execution time t required by the filling operation of a new container 101 that is delivered to the apparatus and carried out in the receiving station 2, this does not have an effect on the number of containers finished per cycle because the apparatus 1 is able to move this new filled container 101 to the workstation 3, located on the other side of the receiving station 2, while the workstation 4 finishes its sealing operation on the container 100.

In FIGS. 4 to 20, a possible work sequence of the apparatus 1 of FIGS. 2 and 3 is described in greater detail.

Figure 4:
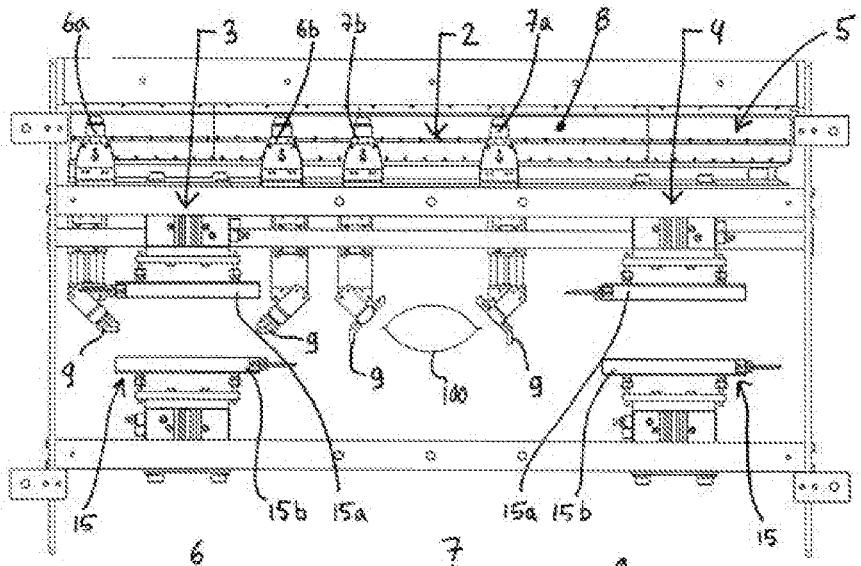
FIGS. 4 to 20 show a possible sequence of operations among all of the possibilities that are offered by the apparatus of the FIGS. 2 and 3, which exemplify the method of the invention.

FIG. 4 shows the initial start position of the apparatus 1 in which the holding group 7 formed by the arm pair 7*a* and 7*b*, with its grippers 9 in an open position, is located on the receiving station 2 and is ready to receive a container 100 in its open position.

Figure 5:
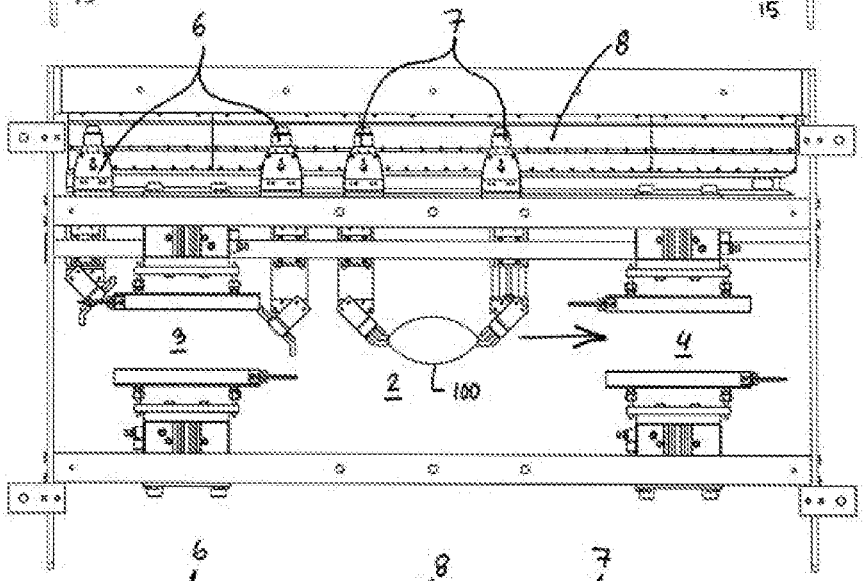

FIG. 5 shows the reception of the container 100 on the receiving station 2, which will be held suspended by the grippers 9 of the arms 7*a* and 7*b* while the filling operation of the container 100 is carried out.

Figure 6:
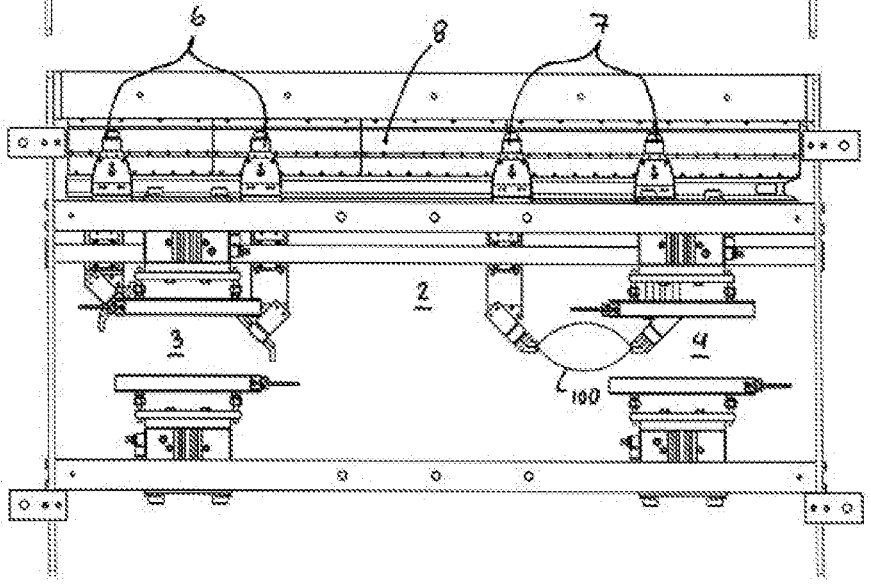
Figure 7:
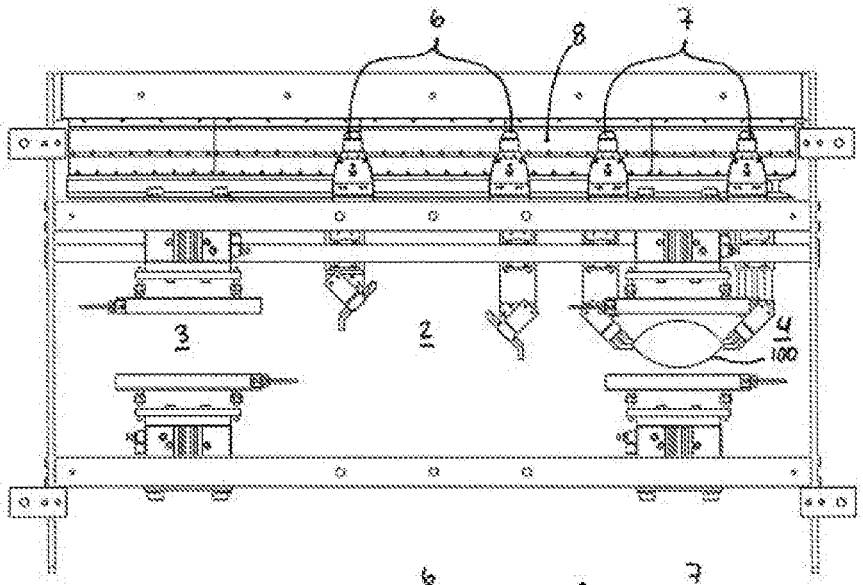
Figure 8:
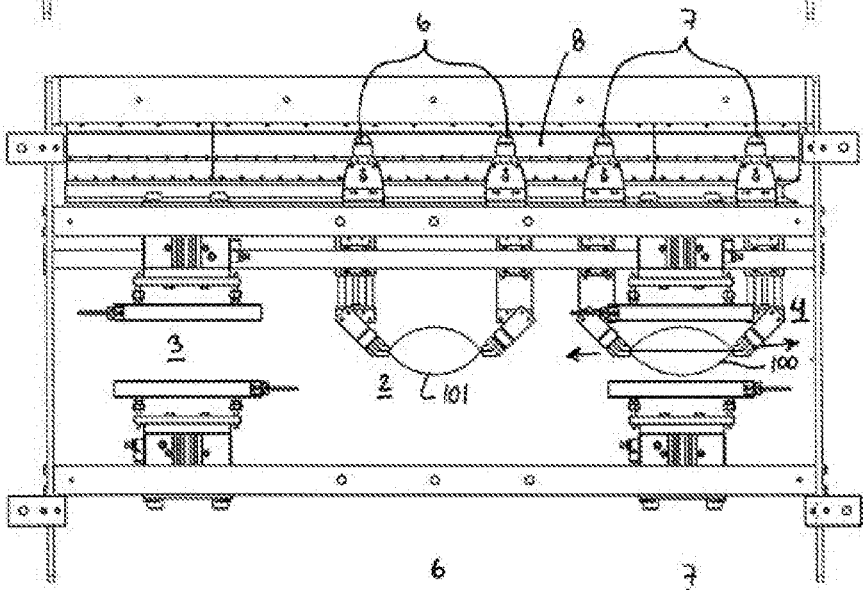
Figure 9:
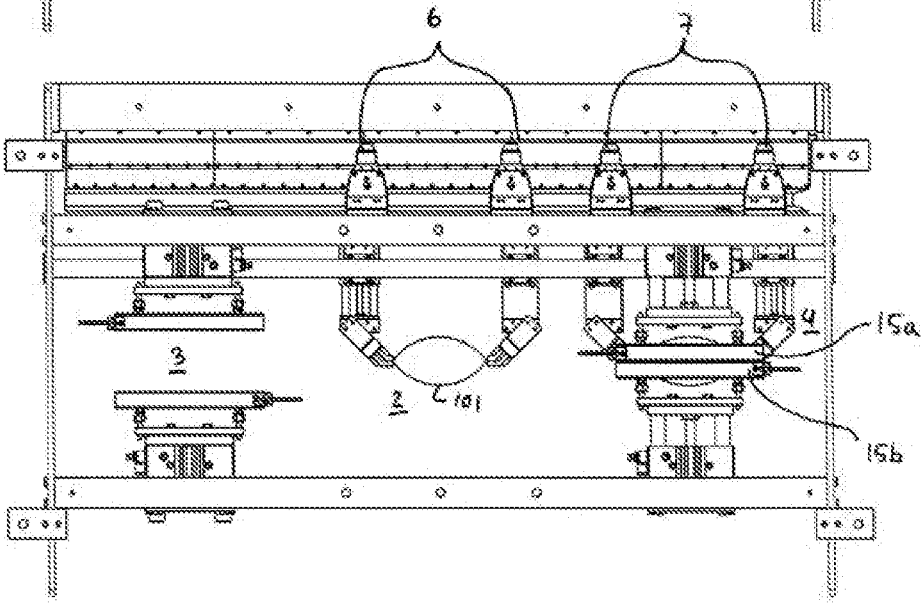

When the filling operation on the receiving station 2 is complete, the arms 7*a* and 7*b* will move in a coordinated way to transfer the container 100 to the workstation 4, leaving the receiving station 2 free so that the holding group 6 can move to that station as it waits to receive a new container, as shown in FIGS. 6 to 8.

At the moment shown in FIG. 8, it may be observed that since the arms 7*a* and 7*b* of the holding group 7 can be moved individually, slightly increasing the distance between them, it is possible to pull on the edges of the held container 100, pulling them apart in order to close the opening of the container 100.

While the closing group 15 on the workstation 4 proceeds to close the container 100, the holding group 6 that holds the container 101 can start to move itself in the direction of the workstation 3 in order to transfer the container 101 to this workstation 3 once the filling operation on receiving station 2 has finished, as shown in FIGS. 9 to 12.

Figure 10:
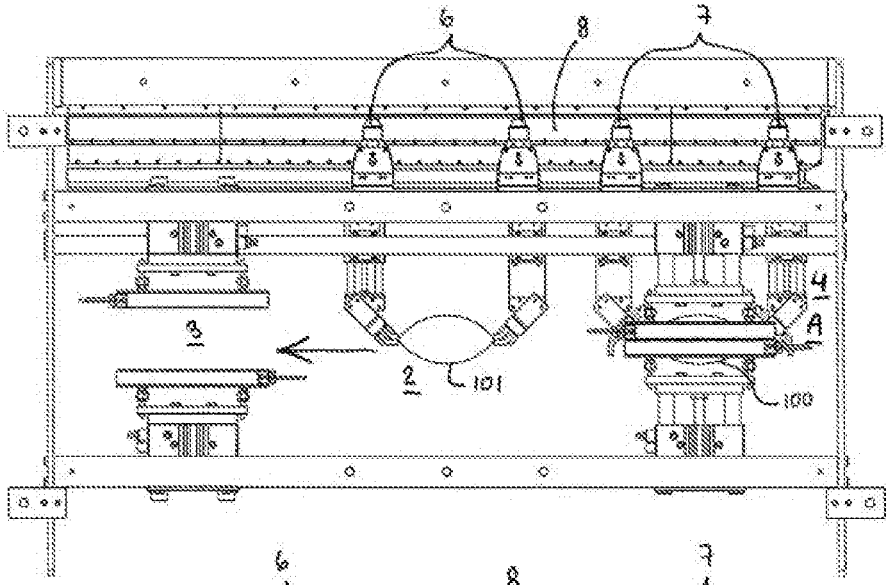

At the moment shown in FIG. 10, it may be observed that when the container 100 is gripped by the clamps 15*a* and 15*b* of the closing group 15, the grippers 9 of the holding group 7 can open to release the container, thus being able to start the return movement of the holding group 7 to the receiving station 2, even when the sealing operation has not finished, saving time by preparing the apparatus 1 to receive a new container.

Figure 11:
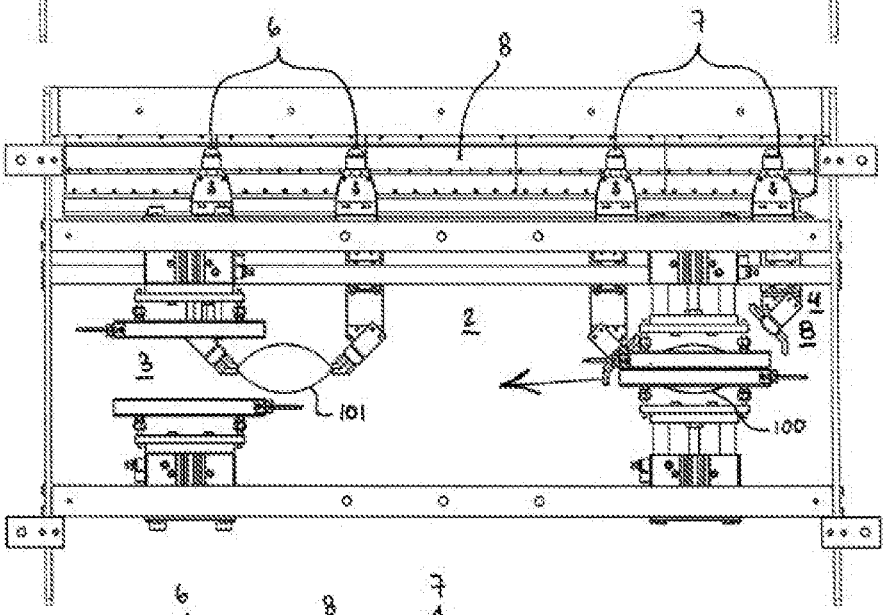

At the moment shown in FIG. 11, it may be observed that in addition to being the furthest from the receiving station 2, the gripper associated with the arm 7*a* is retractable, being able to adopt an operating position (A) (shown in FIG. 10) and a retracted position (B) (shown in FIG. 11) which allows the associated arm 7*a* that is in the direction of the receiving station 2 to operate without having this movement impeded by the position occupied by the container 100 while the sealing operation on workstation 4 finishes.

Figure 12:
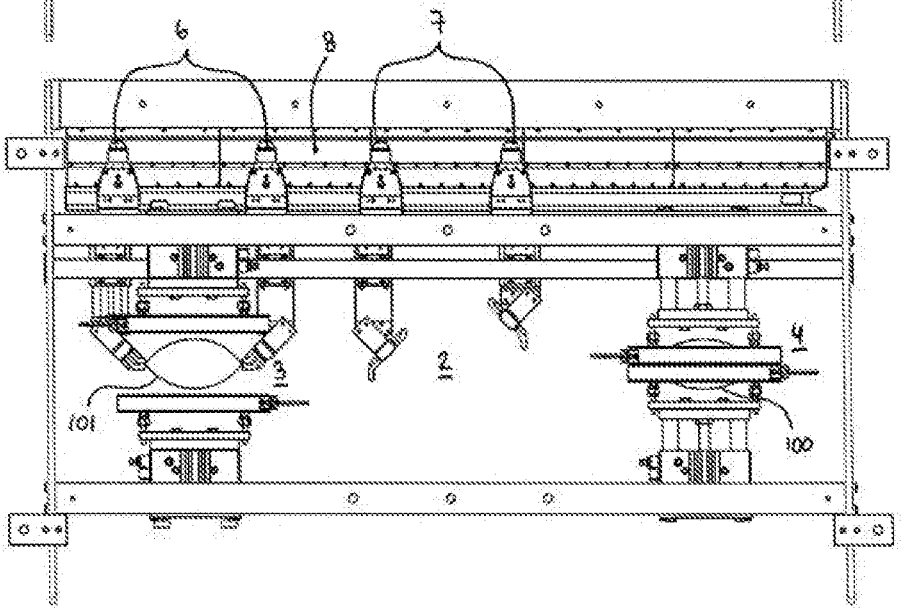
Figure 13:
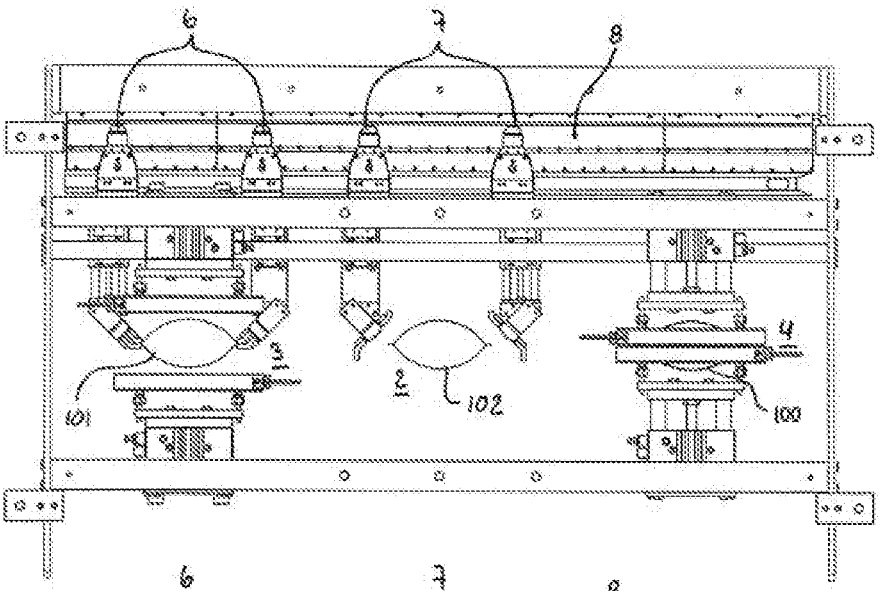
Figure 14:
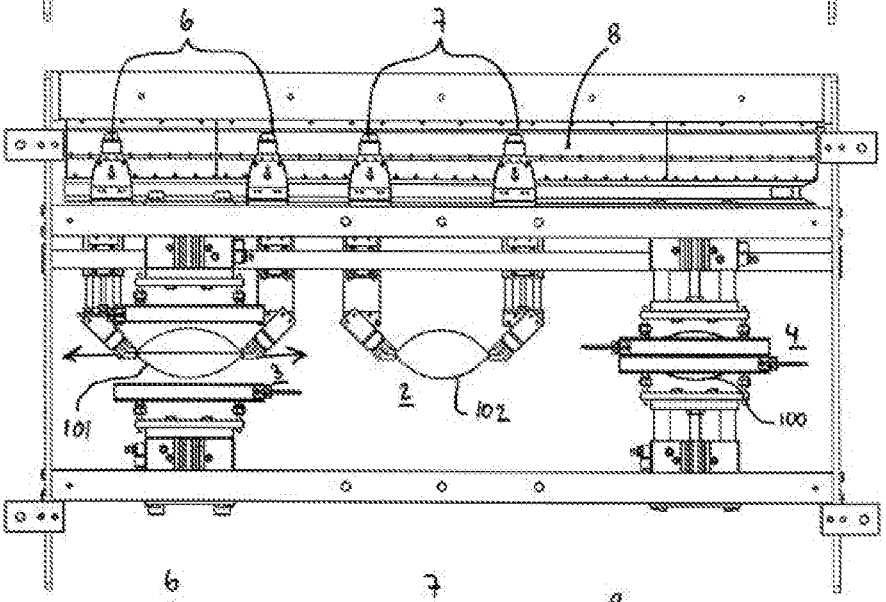
Figure 15:
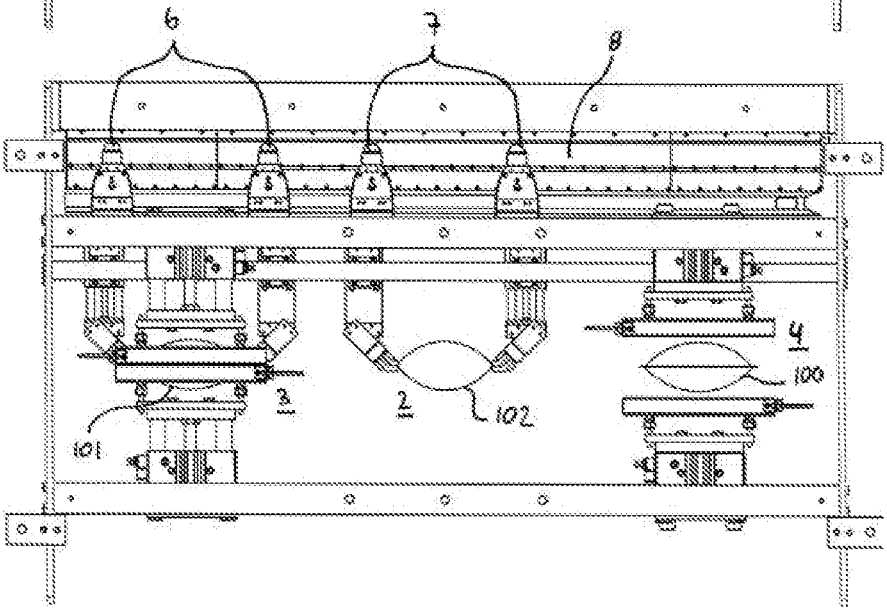
Figure 16:
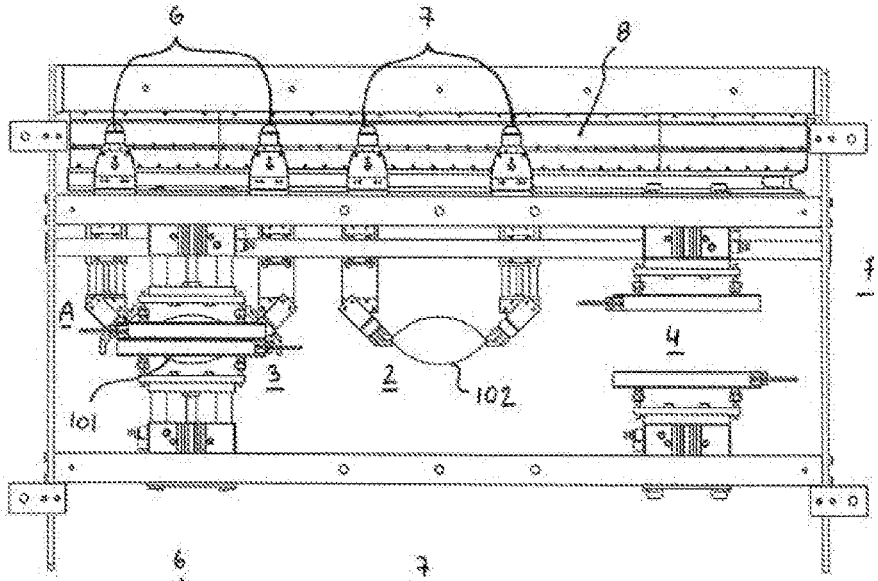
Figure 17:
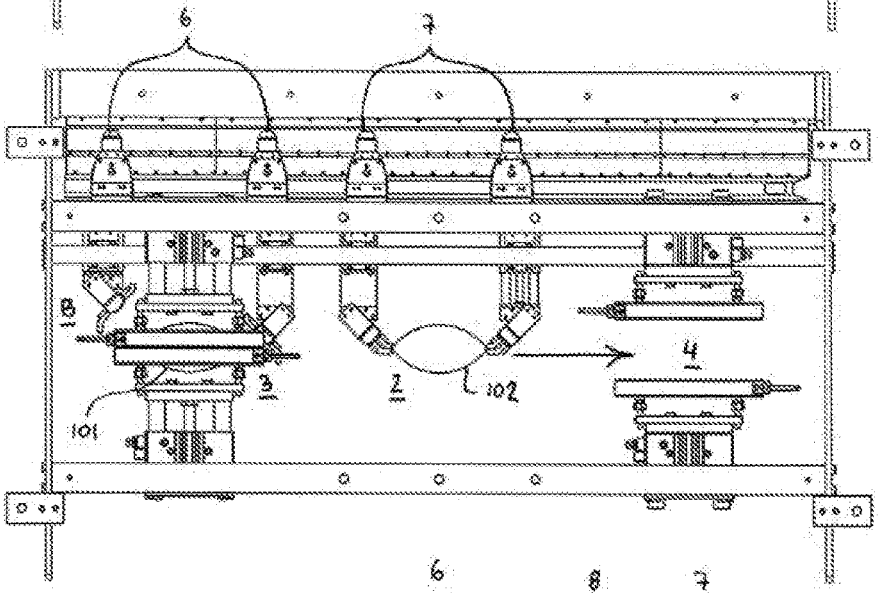
Figure 18:
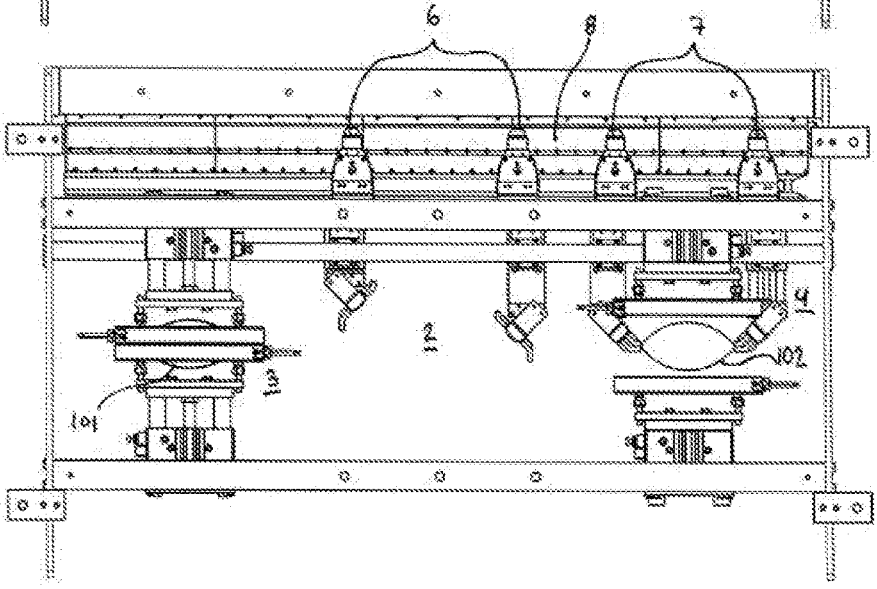
Figure 19:
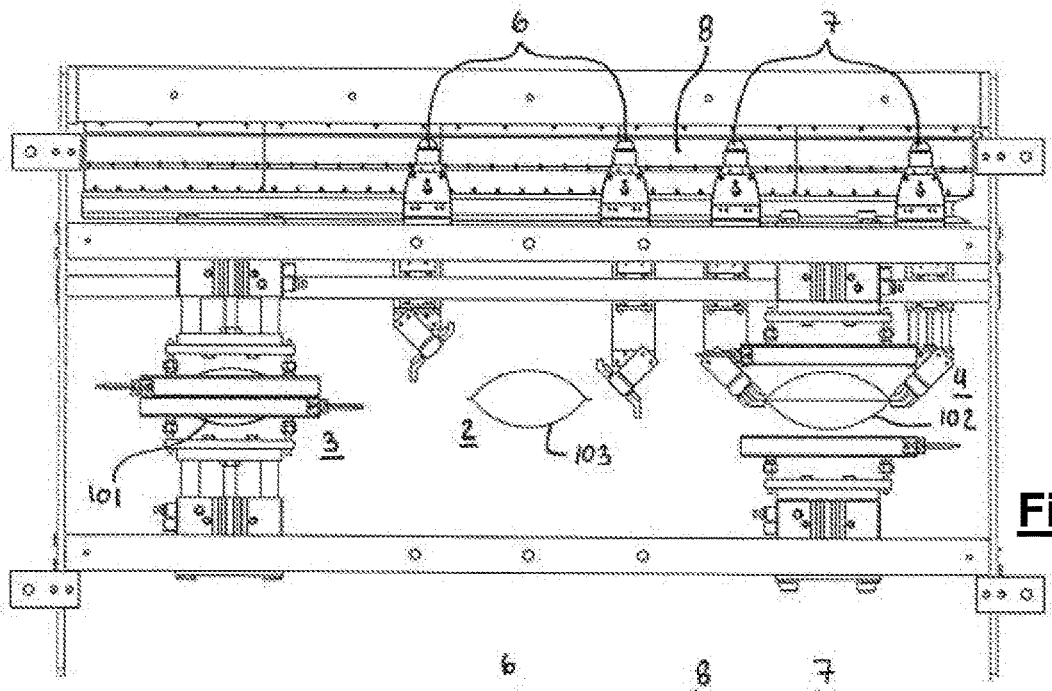
Figure 20:
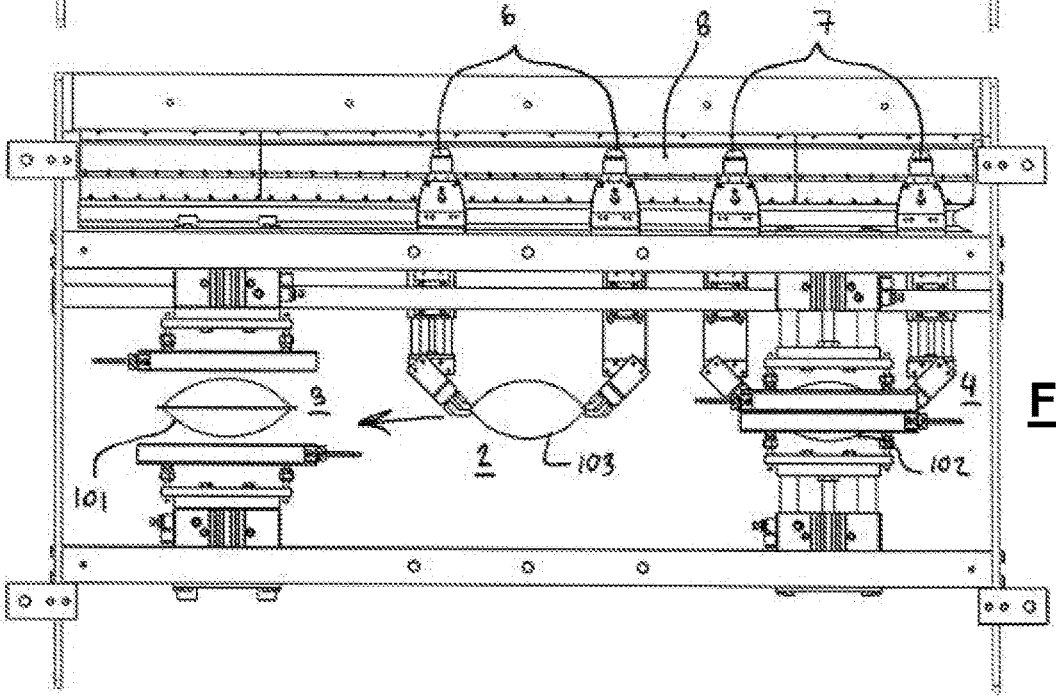

From the situation shown in FIG. 12, the work cycle of the apparatus 1 is repeated, as shown in the sequence of FIGS. 13 to 20, as the holding group 7 receives a new container 102 on the receiving station 2 and ensures its movement, once this container 102 is filled, to the workstation 4, all while the sealing process of the container 101 is being carried out on workstation 3.

Although the workstation 2 in the apparatus of the example is prepared to carry out the filling operation on the containers that are delivered to the apparatus 1 and the workstations 3 and 4 are prepared to carry out the sealing operation on the containers, the invention may be applied to apparatuses that carry out other types of operations on the containers, or even to apparatuses with workstations that are prepared to carry out more than one operation on the containers, for example, operations to remove oxygen from the containers and from the filling; or to seal containers and apply a cap or similar.

Figure 21:
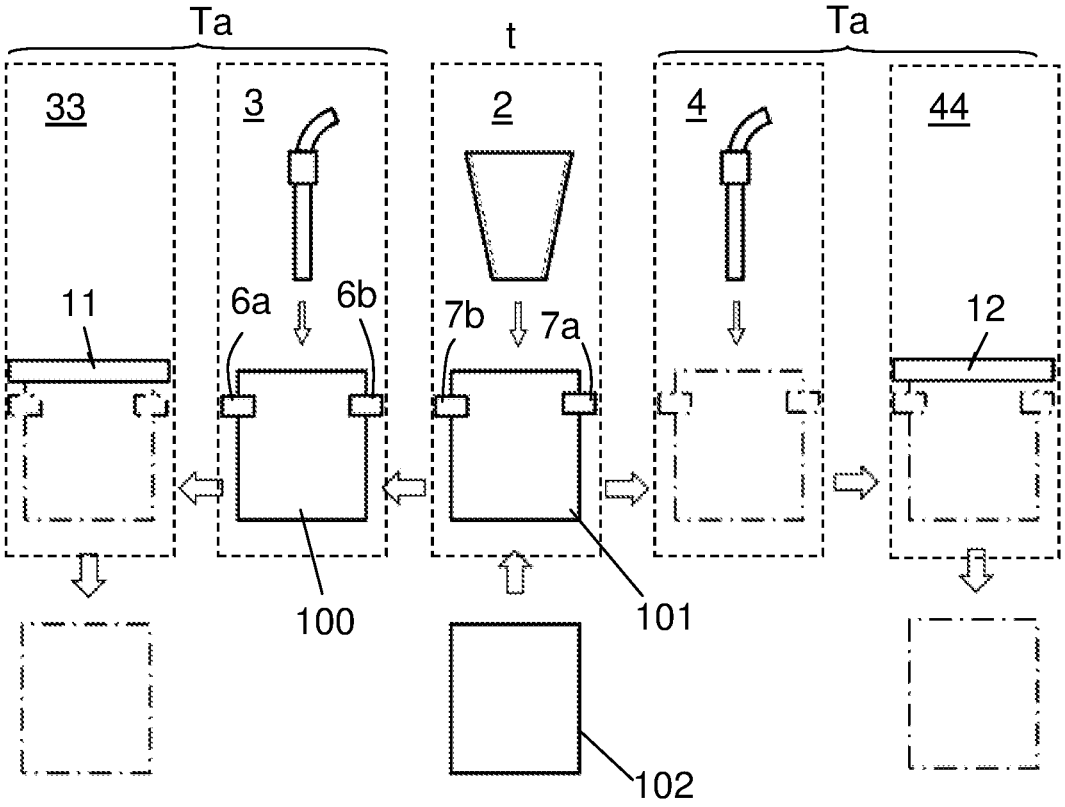
FIG. 21 shows a schematic view of the arrangement of the workstations in an apparatus in accordance with other embodiments that have a centered receiving station; and two workstations on each side of said receiving station.

Furthermore, the invention also provides that there be more than one workstation on each side of the receiving station 2, as FIG. 21 would be shown in a schematic view, which shows a schematic view of the arrangement of an apparatus according to the invention of a receiving station 2 on one side which has two work stations 3 and 33; and on the other side which has two workstations 4 and 44.

In the case of the example shown in FIG. 21, it is provided that the first holding group, with its arms 6*a* and 6*b*, hold a container 100 received in the receiving station 2 and transports in a sequential way first to the workstation 3 and then to the workstation 33, where it will be transferred to a fixed holding station 11 that will grip the container for at least part of the operation that is carried out in this station 33; then it will return to the receiving station 2 and handle a third container 102 because a second holding group, with its arms 7*a* and 7*b*, and in a coordinated way with the first holding group, will have already held a second container 101 received in the receiving station 2 while the first holding group 6 was not in this same position and will have started to move, also in a sequential way, first to the workstation 4 and afterwards to the workstation 44, where it will be transferred to a fixed holding group 12 which will grip the container for at least part of the operation that is carried out in this station 44; then it will return to the receiving station 2 and handle a fourth container, and so on.

Different operations can be carried out on the receiving station 2 and on the workstations 3, 33, 4 and 44, where only by way of example has a filling operation for the receiving station 2 been shown; oxygen removing operations on stations 3 and 4; and sealing operations on stations 33 and 44. Like in the apparatus 1 of the example of FIGS. 2 and 3, the same groups that ensure the sealing of the containers on stations 33 and 44 can carry out the function of the fixed holding groups 11 and 12.

The type of product to be packaged will determine the needs of the packaging operation. Thus, for example, in another alternative variant, container filling operations can be carried out in stations 3 and 4 with a product that is different than that introduced in the receiving station 2, such that the method according to the invention also become optimal for the cases in which more than one product must be introduced into each container.

This variant with more than one workstation on each side of the receiving station is of particular interest when the accumulated time Ta needed by the workstations located on the same side of the receiving station is greater than the execution time t that is required by the operation that is carried out on the container or group of containers on the receiving station 2.

As explained above, both the method as well as the apparatus which are the object of the invention are able to work simultaneously on more than one container at a time.

Figure 22:
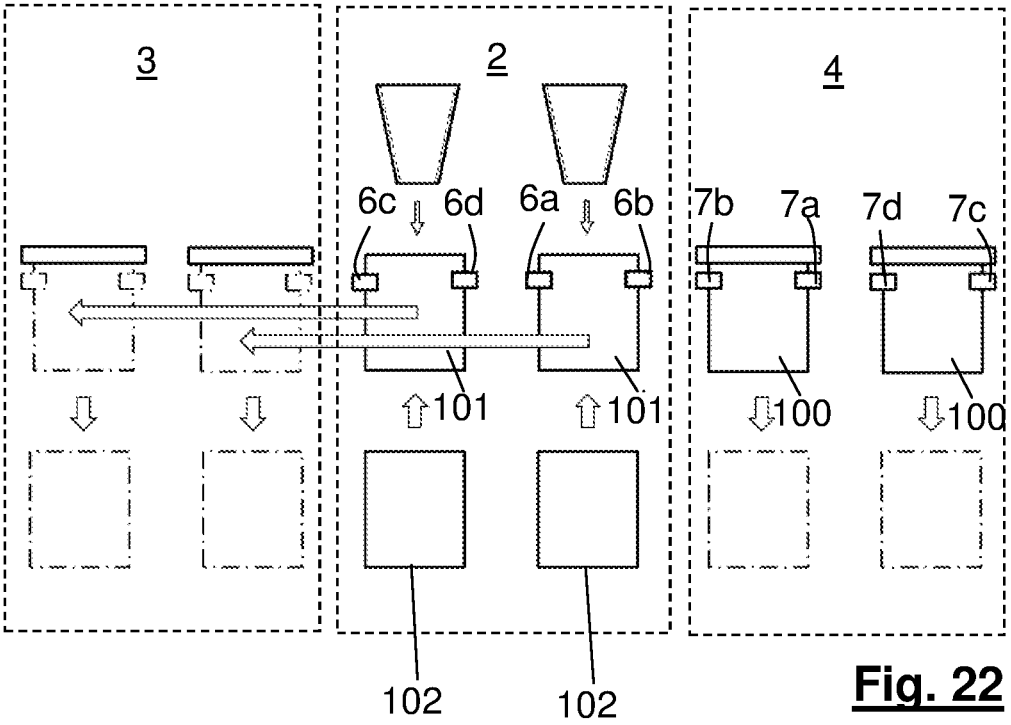
FIG. 22 shows a schematic view of another variant of the invention in which more than one container is simultaneously supplied and transported to one side and the other of the receiving station.

Along these lines, FIG. 22 shows a method in which there are groups of more than one container, in this case, groups of two, that are supplied to the receiving station 2 and will be operated on or manipulated on this receiving station 2, for example, so that they can be filled. Similar to the versions of the method that were explained previously, the groups of containers supplied will be transferred to one side of the receiving station, in this case the stations 3 and 4, and to the other, so that they will be equipped to handle and operate all of the containers of the transferred group at the same time.

Implementation only requires doubling the capacity of the receiving stations and workstations, where naturally more than one station can be located on each side of the receiving station and the machine of the holding groups can be equipped to prepare those groups to hold and transport groups of containers instead of an individual container. In the example shown in FIG. 22, each holding group must have two pairs of arms, labelled in FIG. 22 as 6*a* and 6*b*, 6*c* and 6*d* for a first holding group; and 7*a* and 7*b*, 7*c* and 7*d* for a second holding group.

The invention claimed is:

1. An apparatus for the packaging of products in pre-made containers, comprising a receiving station for a container or group of containers and two workstations arranged one on each side of the receiving station; the apparatus further comprising container transfer means equipped with two holding groups, each holding group prepared to hold in a suspended way a corresponding container or group of containers received in the receiving station and that can move between two positions, one that coincides with the container receiving station and the other that coincides with one of the two workstations, such that the holding groups of the transfer means are configured to alternate in transporting the pre-made containers received in the receiving station between the workstation at one side of the receiving station and the workstation at the other side of the receiving station, wherein the transfer means comprise a track or guide element upon which the holding groups are slidably mounted and are individually operable in two transportation directions, each of the holding groups comprising two arms, each arm equipped with a gripper device, such that each arm is slidably mounted on the track or guide element and in the two transportation directions so that the two arms of each holding group are configured to open apart and close together; and wherein the track or guide element follows an open path; and wherein the apparatus is configured to move individually each holding group between the reception station and the workstations.

2. The apparatus according to claim 1, wherein each arm of each holding group is operated individually along the track or guide element.

3. The apparatus according to claim 2, wherein each holding group is configured to be operated individually so as to slide along the rail or guide due to a magnetic field generated in an area of influence of each holding group; the apparatus comprising programmable means of control that are able to individually control the movement of those holding groups.

4. The apparatus according to claim 2, wherein each holding group and each arm of each holding group is configured to be operated individually so as to slide along the rail or guide due to a magnetic field generated in an area of influence of each holding group; the apparatus comprising programmable means of control that are able to individually control the movement of each holding group and each arm of each holding group.

5. The apparatus according to claim 1, wherein at least one workstation on each side of the receiving station is equipped with a fixed holding group of containers, to which the mobile holding groups can transfer the held containers when they are in a static position that coincides with said workstations.

6. The apparatus according to claim 1, comprising two adjacent workstations on each side of the receiving station, and each holding group moves between the container receiving station and each of the two workstations arranged on a same side of the receiving station, whereby the transfer means are not only able to alternate to transport the pre-made containers received in said receiving station to one side of the receiving station and to the other, and to corresponding workstations, in an alternating way, but can also transport the pre-made containers from one workstation to another adjacent workstation.

7. The apparatus according to claim 1, wherein the gripper device associated with the arm that is furthest from the receiving station is retractable, thus being able to adopt an operating position and a retracted position which allows the associated arm that is in a direction of the receiving station to operate without having to pull the container away from a natural delivery position.

8. The apparatus according to claim 1, wherein the least two workstations are configured to carry out a same operation on the containers.

9. The apparatus according to claim 1, wherein the receiving station is equipped with filling means for the containers that are transferred to the receiving station.

10. The apparatus according to claim 1, wherein the track or guide element follows a straight path.

11. A method for packing products in pre-made containers used in the apparatus according to claim 1, which comprises a) the transfer of a first pre-made container to the receiving station so that the first pre-made container is held by a first holding group located in a standby position at the receiving station;

b) moving the first holding group from the receiving station to a first workstation located on a first side of the receiving station, transporting with the first holding group the first container;

c) moving a second empty holding group from a workstation located on a second side of the receiving station to the aforementioned receiving station, disposing the second empty holding group in the said standby position of the receiving station;

d) the transfer of a second pre-made container to the receiving station so that the second pre-made container is held by the second holding group located in the standby position at that receiving station;

e) moving the second holding group from the receiving station to a second workstation located on the aforementioned second side of the receiving station, transporting with the second holding group the second container; and f) moving the first holding group from a workstation located on the first side of the receiving station to the aforementioned receiving station;

wherein at least operations b) and c) or e) and f) are not coincident in time or are only partially coincident in time.

12. The method according to claim 11, wherein, prior to step f) of moving the first holding group from one of the workstations located on the first side of the receiving station to said receiving station, transfering the container or group of containers to said workstation.

13. The method according to claim 11, wherein in the operations a) and d), the container is open as the container is transferred to the receiving station.

14. The method according to claim 11, wherein each holding group comprises two arms, each arm equipped with a gripper device to grip a container, wherein a distance between the two arms of each holding group varies to close a gripped container.

15. A method for packing products in pre-made containers used in the apparatus according to claim 1, which comprises a) the transfer of a first pre-made container to the receiving station so that the first pre-made container is held by a first holding group located in a standby position at the receiving station;

b) moving the first holding group from the receiving station to a first workstation located on a first side of the receiving station, transporting with the first holding group the first container;

c) moving a second empty holding group from a workstation located on a second side of the receiving station to the aforementioned receiving station, disposing the second empty holding group in the said standby position of the receiving station;

d) the transfer of a second pre-made container to the receiving station so that the second pre-made container is held by the second holding group located in the standby position at that receiving station;

e) moving the second holding group from the receiving station to a second workstation located on the aforementioned second side of the receiving station, transporting with the second holding group the second container; and f) moving the first holding group from a workstation located on the first side of the receiving station to the aforementioned receiving station;

wherein a packaging operation, is carried out on the container or, if applicable, on the group of containers that is held in the receiving station with an associated execution time t; and a packaging operation that is different from the one carried out in the receiving station, is carried out on the container or containers in each of the first and second workstations, each one located on one side of the receiving station, with an associated execution time T, where t<T.

16. A method for packing products in pre-made containers used in the apparatus according to claim 1, which comprises a) the transfer of a first pre-made container to the receiving station so that the first pre-made container is held by a first holding group located in a standby position at the receiving station;

b) moving the first holding group from the receiving station to a first workstation located on a first side of the receiving station, transporting with the first holding group the first container;

c) moving a second empty holding group from a workstation located on a second side of the receiving station to the aforementioned receiving station, disposing the second empty holding group in the said standby position of the receiving station;

d) the transfer of a second pre-made container to the receiving station so that the second pre-made container is held by the second holding group located in the standby position at that receiving station;

e) moving the second holding group from the receiving station to a second workstation located on the aforementioned second side of the receiving station, transporting with the second holding group the second container; and f) moving the first holding group from a workstation located on the first side of the receiving station to the aforementioned receiving station;

wherein there is more than one workstation on each side of the receiving station and the same holding group transports a container or a group of containers from one of the workstations to another adjacent one of the workstations; and a packaging operation is carried out on the container or containers that are held in the receiving station with an associated execution time t; and packaging operations that are different from the ones carried out in the receiving station are carried out in the workstations on the same side of the receiving station with an accumulated associated time Ta, where t<Ta.

17. An apparatus for the packaging of products in pre-made containers, comprising a receiving station for a container or group of containers and two workstations arranged one on each side of that receiving station; the apparatus further comprising container transfer means equipped with two holding groups, each holding group prepared to hold in a suspended way a corresponding container or group of containers received in the receiving station and that can move between two positions, one that coincides with the container receiving station and the other that coincides with one of the two workstations, such that the holding groups of the transfer means are configured to alternate in transporting the pre-made containers received in the receiving station to the workstation at one side of the receiving station and to the workstation at the other side of the receiving station, wherein the transfer means comprise a track or guide element upon which the holding groups are slidably mounted;

wherein the track or guide element follows an open path; and wherein the gripper device associated with the arm that is the furthest from the receiving station is retractable, thus being able to adopt an operating position and a retracted position which allows the associated arm that is in the direction of the receiving station to operate without having to pull the container away from its natural delivery position.

* * * * *